US008692463B2

(12) United States Patent
Hasegawa et al.

(10) Patent No.: US 8,692,463 B2
(45) Date of Patent: Apr. 8, 2014

(54) PLASMA DISPLAY PANEL HAVING INERT FILM AND MANUFACTURING METHOD

(75) Inventors: Minoru Hasegawa, Fujisawa (JP); Shinya Fukuta, Yokohama (JP); Keiichi Betsui, Yokohama (JP); Yasunobu Hashimoto, Kawasaki (JP)

(73) Assignee: Hitachi Consumer Electronics Co., Ltd., Tokyo (JP)

( * ) Notice: Subject to any disclaimer, the term of this patent is extended or adjusted under 35 U.S.C. 154(b) by 931 days.

(21) Appl. No.: 12/863,640

(22) PCT Filed: Nov. 28, 2008

(86) PCT No.: PCT/JP2008/003524

§ 371 (c)(1),
(2), (4) Date: Jul. 20, 2010

(87) PCT Pub. No.: WO2010/061425

PCT Pub. Date: Jun. 3, 2010

(65) Prior Publication Data

US 2010/0289726 A1 Nov. 18, 2010

(51) Int. Cl.
*H01J 17/49* (2012.01)

(52) U.S. Cl.
USPC ..... 313/587; 445/25

(58) Field of Classification Search
USPC ..... 313/582–587; 445/24, 25; 345/60
See application file for complete search history.

(56) References Cited

U.S. PATENT DOCUMENTS

| | | | | |
|---|---|---|---|---|
| 5,938,494 | A | 8/1999 | Betsui et al. | |
| 2006/0113914 | A1 * | 6/2006 | Fujitani et al. | 313/586 |
| 2007/0108905 | A1 * | 5/2007 | Kurauchi et al. | 313/582 |
| 2007/0126361 | A1 * | 6/2007 | Lee | 313/586 |
| 2007/0170950 | A1 * | 7/2007 | Lee | 324/770 |
| 2008/0157671 | A1 * | 7/2008 | Naoi et al. | 313/586 |
| 2008/0278074 | A1 * | 11/2008 | Yamamoto et al. | 313/582 |
| 2010/0019645 | A1 * | 1/2010 | Lee et al. | 313/307 |

FOREIGN PATENT DOCUMENTS

| | | |
|---|---|---|
| JP | 10-149767 | 6/1998 |
| JP | 3073451 | 6/2000 |
| JP | 2000-348626 | 12/2000 |
| JP | 3563994 | 6/2004 |
| JP | 2008-091247 | 4/2008 |
| WO | WO 2005098889 A1 * | 10/2005 |
| WO | WO 2009090855 A1 * | 7/2009 |

* cited by examiner

*Primary Examiner* — Nimeshkumar Patel
*Assistant Examiner* — Glenn Zimmerman
(74) *Attorney, Agent, or Firm* — Antonelli, Terry, Stout & Kraus, LLP.

(57) ABSTRACT

A protective film (6) having a high secondary-emission coefficient is formed on a dielectric layer (5) so as to lower the discharge voltage of a plasma display panel. When the protective film (6) is exposed to the air, it will transform or become cloudy, or the secondary-emission coefficient will lower. To prevent this problem, an inert film (60) is formed on the surface of the protective film (6). As the inert film (60), a film of a metal oxide such as $SiO_2$ and a film of a metal such as Tb are simultaneously formed. Thus, an inert film (60) excellent in barrier property against oxygen and water in the air and enabling easy sputtering from near the discharge electrode at the aging step can be obtained. With this, a plasma display panel exhibiting a low discharge voltage can be realized.

5 Claims, 4 Drawing Sheets

PLASMA DISPLAY PANEL HAVING INERT FILM AND MANUFACTURING METHOD

TECHNICAL FIELD

This invention relates to a display device, and relates to a structure of a plasma display panel capable of operating at a reduced discharge voltage and a method for manufacturing the plasma display panel.

BACKGROUND ART

The demand for PDP display devices using a plasma display panel (PDP) grows as a flat display capable of large-screen displays. The PDP display device includes a plasma display panel, a front panel placed on the front of the plasma display panel, a drive circuit placed on the back of the plasma display panel, a frame containing them, and the like.

On the front substrate scan electrodes extend from, for example, the left-hand end of the front substrate to the display area, while discharge-sustain electrodes extend from, for example, the right-hand end of the front substrate to the display area. On the back substrate, address electrodes each extend in a direction at right angles to the scan electrode and the discharge-sustain electrode. Sub-pixels are respectively formed in positions corresponding to the intersections of the address electrodes with the scan and discharge-sustain electrodes. The sub-pixels are arranged in matrix form in the display area to form an image.

A discharge is initiated between the scan electrode and the discharge-sustain electrode which are formed on the front substrate, to cause a phosphor in each sub-pixel to emit light for generation of an image. In this regard, in general, a voltage of 180V to 190V is applied between the scan electrode and the discharge-sustain electrode in order to initiate a discharge between the scan electrode and the discharge-sustain electrode. Accordingly, a dielectric layer is deposited to cover the scan electrode and the discharge-sustain electrode for preventing dielectric breakdown from occurring between the scan electrode and the discharge-sustain electrode.

For maintaining a low discharge voltage, it is desirable that a substance having a low secondary electron emission coefficient $\gamma$ exists in the discharge space. Therefore, the surface of the dielectric layer is coated with an approximately 1-μm thick coating of MgO having a high secondary electron emission coefficient $\gamma$ as a protective film. However, MgO is deliquescent and therefore exposure of it to the air transforms the surface of the protective film, thus making the surface become clouded or decreasing the secondary electron emission coefficient.

A measure to prevent such transformation of the protective film in the air as described above is described in "Patent Literature 1" in which the protective film is temporarily covered with a protective film such as an $SiO_2$ film (hereinafter referred to as "inert film"), and then the inert film is removed around electrodes by generating a discharge after a plasma display panel is completed. On the other hand, "Patent Literature 2" describes the use of SiOx for an inert film in which x is set to a value ranging from 1.3 to 1.9 to improve the barrier properties against oxygen or moisture vapor.

Patent Literature 1: JP Patent 3073451

Patent Literature 2: JP Patent 3563994

DISCLOSURE OF THE INVENTION

Problem to be Solved by the Invention

The protective film placed on the display substrate is required to have a high secondary electron emission coefficient in order to start and sustain a discharge at a lower voltage. In most cases, a magnesium oxide film is used as a material of the protective film to fulfill this requirement. The magnesium oxide is a material sufficiently withstanding practical use. However, a material having a higher secondary electron emission coefficient than that of magnesium oxide is required to reduce the power consumption when driving the plasma display panel, that is, to initiate a discharge at a low voltage.

As materials having a high secondary electron emission coefficient for this purpose, strontium oxide, calcium oxide and the like have been found, but the film of strontium oxide, calcium oxide and/or the like are unstable because, upon exposure to the air, they are converted to carbonate or hydroxide, so that it is impossible to take full advantage of strontium oxide, calcium oxide or the like without any additional process from the viewpoint of the manufacturing process. An approach to address this problem is proposed, in which, as described in "Patent Literature 1", the surface of the film of strontium oxide, calcium oxide or the like after the film formation process is covered with an inert film to inhibit reaction with the air, and then the inert film is removed after the completion of the panel.

Such an inert film is required (1) to be easily deposited by sputtering and (2) to have the ability to completely seal a high $\gamma$ material included in the underlayer from carbon dioxide and moisture vapor in the atmosphere (to have outstanding barrier properties). Examples of materials fulfilling the requirement of property (1) include $SiO_2$. However, since $SiO_2$ contains many structural defects, it does not adequately fulfill the requirement of (2) barrier properties. There is "Patent Literature 2" as a method for improving such inadequate barrier properties of $SiO_2$. "Patent Literature 2" employs SiOx (x=1 to 1.9) with a lower number of bonds for oxygen atom than that of $SiO_2$ to improve the barrier properties. However, this method does not offer adequate barrier properties, and also raises problems of the difficulty of controlling the aforementioned value x, and the like.

It is an object of the present invention to form an inert film having outstanding sputtering properties and outstanding barrier properties. Also, it is an object of the present invention to use this inert film thus formed to achieve a stable plasma display panel capable of low discharge voltage operation.

Means for Solving Problem

The present invention is made to solve the problems as described above, and the following is the specific means.

(1) A plasma display panel includes a front substrate on which a dielectric layer is formed to cover first discharge electrodes and second discharge electrodes and a protective film is formed to cover the dielectric layer, and a back substrate on which a dielectric layer is formed to cover address electrodes and partition walls are formed on the dielectric layer, the front and back substrates being sealed together by a sealing material formed along a periphery. An inert film is formed of a metal oxide and a metal on the protective film, and portions of the inert film corresponding to the discharge electrodes are removed.

(2) The plasma display panel described in (1), wherein, when the amount of metal oxide is x and the amount of metal is y, y/(x+y) ranges from 0.5 mol % to 50 mol %.

(3) The plasma display panel described in (1), wherein the metal oxide is any of metal oxides of $SiO_2$, $Al_2O_3$, $TiO_2$, MgO and ZrO, and the metal is a rare-earth metal such as Tb, La, Ce, Eu, Yb, Y or Sc, an alkaline-earth metal such as Mg, Ca, Sr or Ba, or an alkali metal such as K or Na.

(4) The plasma display panel described in (1), wherein the protective film includes MgO, SrO, CaO, BaO or a mixture including them.

(5) The plasma display panel described in (1), wherein the inert film has a film thickness ranging from 10 nm to 500 nm.

(6) A method of manufacturing a plasma display panel including a front substrate on which a dielectric layer is formed to cover first discharge electrodes and second discharge electrodes, a protective film is formed to cover the dielectric layer and an inert film is formed on the protective film, and a back substrate on which a dielectric layer is formed to cover address electrodes and partition walls are formed on the dielectric layer, the front and back substrates being sealed together by a sealing material formed along a periphery. The method comprises the steps of simultaneous film formation of a metal oxide and a metal by vapor deposition to form the inert film, and removal of a portion of the inert film exposed to a plasma display in an aging step.

(7) The method of manufacturing a plasma display panel described in (6), wherein the vapor deposition includes heating, by electron beam heating, of vapor deposition materials which are a metal oxide and a metal placed in a single hearth.

(8) The method of manufacturing a plasma display panel described in (6), wherein the vapor deposition is performed by placing a metal oxide and a metal in different hearths, and then separately heating and controlling the metal oxide and the metal.

(9) A method of manufacturing a plasma display panel including a front substrate on which a dielectric layer is formed to cover first discharge electrodes and second discharge electrodes, a protective film is formed to cover the dielectric layer and an inert film is formed on the protective film, and a back substrate on which a dielectric layer is formed to cover address electrodes and partition walls are formed on the dielectric layer, the front and back substrates being sealed together by a sealing material formed along a periphery. The method comprises the steps of simultaneous film formation of a metal oxide and a metal by sputtering to form the inert film, and removal of a portion of the inert film exposed to a plasma display in an aging step.

Effect of the Invention

Since a metal such as a rare-earth metal has a high affinity for oxygen, it traps carbon dioxide and moisture vapor in the atmosphere to prevent the carbon dioxide and the moisture vapor from penetrating the underlayer surface of materials having a high secondary electron emission coefficient. As a result, a high γ material surface is kept clean after the inert film has been removed. Since the secondary electron emission from a clean high γ material occurs in a low voltage, a reduction in drive voltage of the PDP is made possible.

In addition, since the present invention allows formation of an inert film having outstanding barrier properties, SrO, CaO, BaO or a mixture including them, which cannot be conventionally easily used for a protective film, can be used for the protective film. Since these films of them have a higher secondary electron emission coefficient than that of MgO, a plasma display panel in which the discharge voltage is low can be achieved.

BEST MODE FOR CARRYING OUT THE INVENTION

The contents of the present invention will be described below in detail with reference to examples.

Example 1

FIG. 1 is an exploded perspective view of the display area of a plasma display panel. The plasma display panel includes two glass substrates, a front substrate 1 and a back substrate 2. On the front substrate 1 each of scan electrodes 20 (hereinafter also called "Y electrode(s) 20") and each of discharge sustain electrodes 10 (hereinafter also called "X electrode(s) 10"), between which a discharge is generated for image formation, are arranged parallel.

The scan electrode 20 in turn includes a scan discharge electrode which is made of ITO (Indium Tin Oxide) and operates actually as a discharge electrode, and a scan bus electrode which is provided for supplying voltage from a terminal. In the following, the scan bus electrode is also called a Y bus electrode 22, and the scan discharge electrode is also called a Y discharge electrode 21. Note that if the "Y electrode 20" is simply described, this means the Y electrode 20 including the Y bus electrode 22 and the Y discharge electrode 21.

The discharge sustain electrode 10 in turn includes a discharge sustain electrode 10 which is made of ITO (Indium Tin Oxide) and operates actually as a discharge electrode, and a discharge-sustain bus electrode which is provided for supplying voltage from a terminal. In the following, the discharge sustain bus electrode is also called an X bus electrode 12, and the discharge sustain electrode 10 is also called an X discharge electrode 11. Note that if the "X electrode 10" is simply described, this means the X electrode 10 including the X bus electrode 12 and the X discharge electrode 11.

Each of the X and Y bus electrodes 12 and 22 has a metal multilayer structure in which chromium, copper and chromium are laminated in this order from the front substrate 1. The chromium deposited on the front substrate 1 has an outstanding adhesion property to glass and has an effect of improving the contrast because the chromium surface is black. Copper is used to reduce the resistance of the bus electrode. The copper is further covered with chromium. The chromium is provided for preventing the copper surface from being oxidized to effect a change in resistance.

In some cases, the chromium on the front glass may have a multilayer structure of chromium oxide and chromium. Since chromium oxide is black and has a lower reflectance than chromium, it is possible to more improve the image contrast. Chromium oxide also has an outstanding adhesion property to glass. In addition, the contact face with copper is chromium, the copper is not oxidized.

In FIG. 1, ITO, which is a transparent conductive film, is used for the discharge electrode, while a metal multilayer film having a low resistance is used for the bus electrode. The use of the transparent conductive film makes it possible to deliver a larger amount of light emitted from a phosphor 8 to the outside. On the other hand, in some cases, the discharge electrode may be made of the same metal as that for the bus electrode. In this case, just one process is required, resulting in a significant reduction in manufacturing cost.

A dielectric layer 5 is deposited to cover the X electrodes 10 and the Y electrodes 20. For the dielectric layer 5, a low-melting-point glass with a softening point of about 500° C. is used. A protective film 6 is deposited on the dielectric layer 5. The protective film 6 is deposited by mainly using magnesium oxide (MgO) through sputtering or vapor deposition techniques. In the present invention, since an inert film 60 is formed on the protective film 6 as described below, rather than MgO, SrO, CaO, BaO or an alloy of them can be employed.

In FIG. 1, an inert film is deposited on the protective film 6 by vapor deposition or sputtering. The inert film 60 is a mixture of a $SiO_2$ film, a rare-earth metal and/or the like. The inert film 60 plays a role in protecting the protective film 6 from oxygen and water in the atmosphere. Portions of the inert film 60 are removed through exposure to a plasma discharge caused by sputtering when a discharge is generated in the aging step after the plasma display panel is completed. The inert film 60 needs to meet a requirement that it protects the protective film 6 from the atmosphere and a requirement that it is readily removed by sputtering upon generation of a discharge, so that the thickness of the inert film 60 is selected from a range from 10 nm to 500 nm.

Note that, in FIG. 1 a black belt may be formed outside each of the X electrode 10 and the Y electrode 20 in order to improve the image contrast in some cases, although the black belt is omitted in the illustration. Because the black belt is provided for improving the contrast, the color is required to be black. For the black belt, a metal multilayer film having the same structure as that of the X electrode 10 or the Y electrode 20 is used. For this reason, the black belt can be formed simultaneously with the X electrode 10 or the Y electrode 20. The metal, which is in contact with the glass-made front substrate, is Cr or CrO, and therefore, is black, thus making it possible to achieve an improvement in contrast.

On the back substrate 2, address electrodes 30 (hereinafter also called "A electrode(s)") are formed to extend at right angles to the X bus electrode 12 or the Y bus electrode 22. The structure of the address electrode 30, which is similar to the structure of the X bus electrode 12 or the Y bus electrode 22, is a chromium-copper-chromium multilayer structure. The address electrodes 30 are covered with a dielectric layer 5. Typically, the dielectric layer 5 deposited on the back substrate 2 is formed by use of the same material as that of the dielectric layer 5 deposited on the front substrate 1.

Partition walls 7 are formed on the dielectric layer 5 of the back substrate 2 to extend in the same direction as that of the address electrode 30 such that the address electrode 30 is located between adjacent partition walls 7. In FIG. 1, lateral walls 71 are formed to extend in a direction perpendicular to the address electrode 30, so that sub-pixels (a sub-pixel is also called a cell) are formed in areas surrounded with the partition walls 7 and the lateral partition walls 71. The inside of the partition walls 7 are coated with the phosphor 8. The coating of the phosphor 8 is applied such that the red, green and blue phosphors 8 are arranged side by side in recesses formed by the partition walls 7 shown in FIG. 1.

The spaces surrounded with the front substrate 1, the back substrate 2 and the partition walls 7 are discharge spaces filled with discharge gas. A range between a pair of the bus wirings and between the partition walls corresponds to one discharge cell (sub-pixel), and in the case of color display, the three sub-pixels respectively correspond to three primary colors (R, G, B) to form one pixel.

The principle of light emission of the plasma display panel will be described below. First, a voltage of about 100V to 200V (a discharge breakdown voltage) is applied between the address electrode 30 corresponding to a cell intended for light emission and the scan electrode 20 corresponding to this cell. Because the address electrode 30 and the bus wiring interest at right angles, a single cell located at the intersection of them can be selected. In the selected cell, a weak discharge is generated between the discharge electrode (the Y electrode 20 in this case) and the address electrode 30 to which the voltage is applied, whereupon electric charge (wall charge) accumulates on the protective film 6 laid on the dielectric layer 5 on the front substrate 1. In this manner, writing is performed on all the cells in the display area using the electric charge. This period is a writing period during which an image is not generated.

Then, in a discharge sustaining period (sustain period), a high frequency pulse is applied between the X electrode 10 and the Y electrode 20 to initiate a sustaining discharge. At this stage, a sustaining discharge is generated only in the cells with the accumulation of wall charge. As a result of this sustaining discharge, ultraviolet light is generated, and the ultraviolet light causes the phosphor 8 to emit light. The visible light produced from the phosphor 8 is emitted from the front substrate 1, which is visibly recognized by a human being. Since the phosphors 8 located in only the cells in which electric charge has accumulated in the writing period emit light, an image is formed.

FIG. 2 shows schematic cross-sectional views illustrating a process in the present invention. FIG. 2 shows the front substrate 1 rotated 90 degrees in the horizontal direction for the sake of clear description of the process according to the present invention. Specifically, as shown in FIG. 1, the X discharge electrodes 11 and the like originally extend in a direction perpendicular to the address electrodes 30, but FIG. 2 shows the discharge electrodes and the address electrodes extending parallel to each other.

In FIG. 2A, the X discharge electrodes 11, the X bus electrodes 12, the Y discharge electrodes 21, the Y bus electrodes 22 and the like are formed on the front substrate 1, and in turn the dielectric layer 5 having a thickness of 20 μm is formed on them. A SrO+CaO material is deposited to a thickness of 1 μm on the dielectric layer 5 by vacuum vapor deposition techniques to form a protective film 6. This is followed by vapor depositing of an evaporation matrix which is a mixture of a metal oxide $SiO_2$ and a metal Tb onto the surface of the protective film 8 to form an inert film 60. The following description is given using $SiO_2$ as an example of metal oxide.

FIG. 4 is a schematic diagram showing the state of evaporating $SiO_2$ and metal Tb. In FIG. 4, an evaporation matrix which is a mixture of $SiO_2$ and metal Tb is placed in a substrate hearth 200, and then is heated by an electron beam to be evaporated. Above the evaporation source, the front substrate 1 after the process of forming protective film 6 is placed in a downward direction on a substrate setting jig 100, and then the evaporation matrix which is a mixture of $SiO_2$ and metal Tb is vapor-deposited onto the front substrate 1. After the completion of the vapor deposition, the front substrate 1 is moved in the direction shown by the arrow to be removed to the outside. The $SiO_2$+CaO is deliquescent, but does not transform because it is covered with $SiO_2$+Tb which is the inert film 60.

If the inert film 60 has a small thickness, the barrier properties cannot be ensured, whereas if it has a large thickness, the time required for a subsequent discharge removal process is increased. A lower limit film-thickness required for obtaining the minimum level of the barrier properties is approximately 10 μm, and an upper limit film-thickness required for allowing the removal process to be terminated within a realistic time period is approximately 500 nm. Ideally, the inert film 60 is desirably formed in a minimum film-thickness offering ensured barrier properties. Accordingly, an ideal film-thickness depends on types or concentrations of mixed metal.

A lower limit of a mixing ratio of required metal is determined based on a lower limit concentration allowing the inert film 60 to have a required level of the barrier properties, and an upper limit of the same is determined such that the inert film 60 does not have electrical conductivity which affects a discharge. A range of metal concentration meeting such requirements is from 0.5 mol % to 50 mol %.

In FIG. 2A, the address electrodes 30 are formed on the back substrate 2, and then a low-melting-point glass is formed in a thickness of 10 μm on the address electrodes 30 and the back substrate 2 to form a dielectric layer 5. Then, for the partition walls 7, a low-melting-point glass paste is applied to form a film, and then a dry film is laminated on the film. The laminated dry film is exposed to light and developed, so that the dry film layer is patterned. After the patterning, the dry film is used as a mask to perform sandblasting, thus forming recesses for discharge spaces. Then, the dry film is removed, and then the back substrate 2 is burned to disperse a binder, resulting in the formation of partition walls 7.

Then, the phosphors 8 are formed in the recesses surrounded with the partition walls 7. Then, the back substrate 2 is coated with frit glass which is to be a sealing layer by use of a dispenser or the like. Then, the front glass 1 and the back glass 2 are combined together and then heated in a baking furnace in order to melt and solidify the frit glass which is a sealing material.

The sealing material is melted and the inside is evacuated through a sealing pipe to produce a vacuum up to about some Pa. Then, for example, a Xe-10%+Ne-90% discharge gas is sealed under about 50 kPa, and then the sealing pipe is tipped off.

FIG. 2B is a schematic cross-sectional view illustrating an aging discharge generated between the discharge electrodes by applying an AC voltage for an aging step between the X discharge electrodes 11 and the Y discharge electrodes 21 of the plasma display panel thus made.

The aging discharge results in removal of the inert film 60, in this case, the Tb—$SiO_2$ layer, on the surface of the protective film 6. The determination whether or not the inert film 60 is removed can be made by monitoring the discharge voltage. FIG. 2C illustrates the state after the removal of the inert film 60 in this manner.

The inert film 60 is not entirely removed from the protective film 6, and only the portions of the inert film 60 corresponding to the discharge electrodes are removed. Since of most of the inert film 60 removed by sputtering adheres to the structures, including the remaining inert film 60, located around the removed portions of the inert film 60, the discharge gas is not contaminated.

The mixing of metal into the inert film 60 in this manner allows the metal to trap carbon dioxide and water in the atmosphere to prevent the carbon dioxide and the water from penetrating the underlying protective film 6 even when the back substrate 2 is exposed to the atmosphere before the sealing process so that degradation of the protective film 6 can be prevented.

The foregoing has described the simultaneous deposition of $SiO_2$ and Tb to form an inert film 60 as an example. Materials for the inert film 60 are not limited to the $SiO_2$ and Tb, and an oxide-metal mixture film, which is obtained by simultaneous deposition of $SiO_2$ and another metal, can be used. Metals that can be used in combination with $SiO_2$ include, in addition to Tb, a rare-earth metal such as La, Ce, Eu, Yb, Y and Sc, an alkaline-earth metal such as Mg, Ca, Sr, Ba and the like, and an alkali metal such as K and Na.

The foregoing has described the use of SrO+Cao as a material for the protective film 6 by way of example. However, materials for the protective film 6 are not limited to this, and Ba, MgO or a mixture including them can be used. At present, MgO is most widely used for the protective film 6, and application of the present invention to an MgO protective film 6 makes it possible to prevent transformation of MgO to achieve a narrower range of variation in discharge breakdown voltage.

The use of SrO, CaO, BaO or a mixture including them which has a large value as a secondary electron emission coefficient and exhibits outstanding properties as a protective film 6 has been previously impossible because they are transformed by oxygen, water and the like in the atmosphere, but the use of them is made possible by the present invention, thus achieving a reduction in the discharge voltage of the plasma display panel.

Example 2

A plasma display panel made in the example is similar in structure to the plasma display panel made in Example 1. This example differs in a method of producing an inert film 60 from Example 1. FIG. 4 shows the method of producing an inert film 60 according to this example. In Example 1, the mixture of $SiO_2$ and Tb is placed in the substrate hearth 200 and then is heated by an electron beam to form a film. In contrast to this, in this example, a $SiO_2$ film and Tb are placed in different hearths and are respectively heated by electron beams for vapor deposition.

$SiO_2$ and Tb differ in vapor deposition rate. In this example, however, since $SiO_2$ and Tb can be independently controlled for vapor deposition, a mixing ratio of two types of vapor-deposition components can be accurately controlled. The front substrate 1 with an evaporated inert film 60 is moved in the direction shown by the arrow in FIG. 4 to be exposed to the atmosphere, which is the same as FIG. 3 in Example 1.

In FIG. 4, the hearth containing $SiO_2$ and the hearth containing Tb are placed in the vapor-deposition chamber. As in the case of Example 1, it is possible to use, in addition to Tb, a rare-earth metal such as La, Ce, Eu, Yb, Y and Sc, an alkaline-earth metal such as Mg, Ca, Sr, Ba and the like, and an alkali metal such as K and Na.

Example 3

A plasma display panel made in the example is similar in structure to the plasma display panel made in Example 1. This example differs in a method of producing an inert film 60 from Examples 1 and 2. In Examples 1 and 2, vacuum vapor deposition is used to form the inert film 60. In this example, however, sputtering is used to form the inert film 60.

FIG. 5 is an example showing a method of forming the inert film 60 according to this example. In FIG. 5, as a sputtering target 300, one with Tb implanted in a $SiO_2$ target is used. In this regard, in a sputtering technique as shown in FIG. 5, sputtering can also be performed when Tb pieces are placed on the $SiO_2$ target. In FIG. 5, $SiO_2$ and Tb sputtered from the sputtering target 300 adhere to the front substrate 1 which is set to the substrate setting jig 100 provided above them.

In FIG. 5, the front substrate 1 is placed in a downward direction. However, a feature of the sputtering technique is that a substrate can be vertically placed unlike FIG. 5. Specifically, when a substrate is horizontally placed as illustrated in FIG. 5, a large-size substrate causes a phenomenon in which the substrate warps. As a result, a system for preventing this phenomenon is necessary. In contrast to this, since sputtering can be performed on a substrate placed in upright position, an increase in size of substrates is facilitated. In this case, the sputtering target 300 is also placed in upright position to be parallel to the substrate.

In the aforementioned example, as a sputtering target 300, one with Tb implanted in a $SiO_2$ target is used. It is possible to use a $SiO_2$ target with a rare-earth metal such as La, Ce, Eu, Yb, Y or Sc, a $SiO_2$ target with an alkaline-earth metal such as Mg, Ca, Sr, Ba or the like, and a $SiO_2$ target with an alkali metal such as K or Na, instead of Tb. In this case, it is possible to form an inert film 60 of an $SiO_2$ film and each metal.

The aforementioned examples have described taking $SiO_2$ as an example of metal oxide. However, the metal oxide is not limited to $SiO_2$, and the present invention can apply in the case of using $Al_2O_3$, $TiO_2$, MgO, ZrO or the like.

REFERENCE SIGNS LIST

Figure 1:
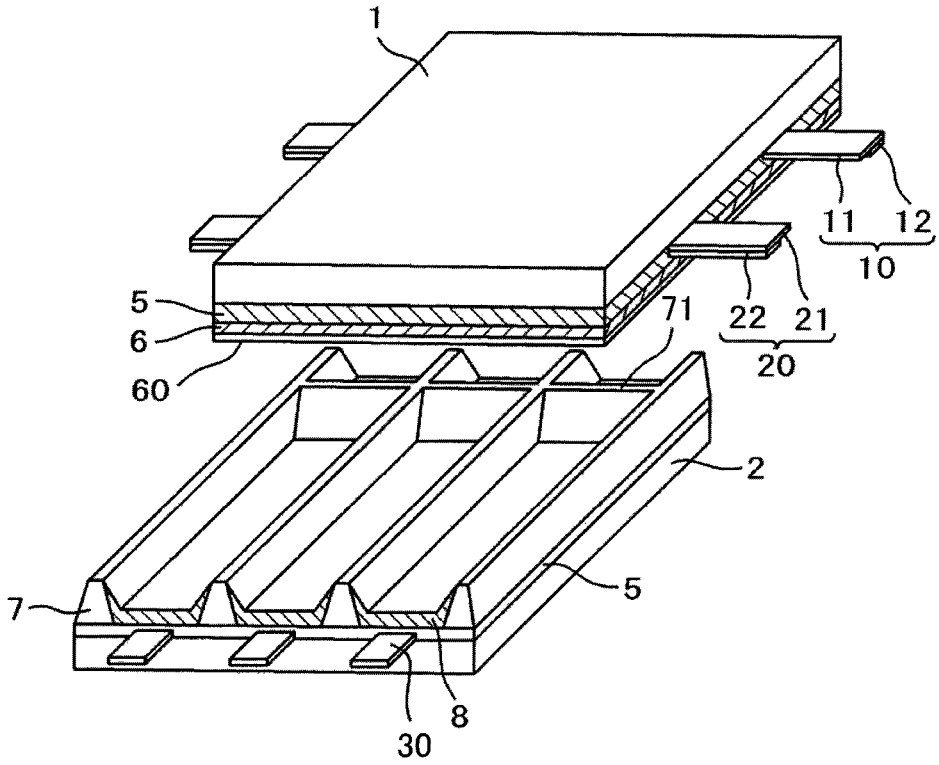
FIG. 1 is an exploded perspective view of a plasma display panel according to the present invention.
Figure 2A:
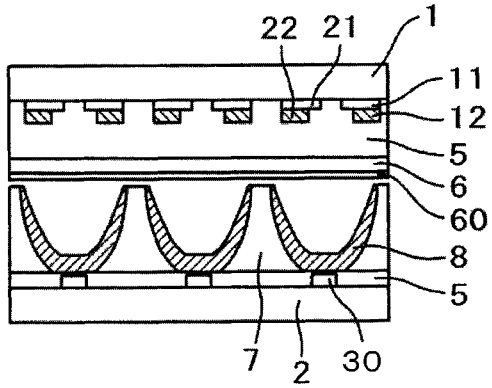
FIG. 2 is a schematic cross-sectional view illustrating a process of the present invention.
Figure 2B:
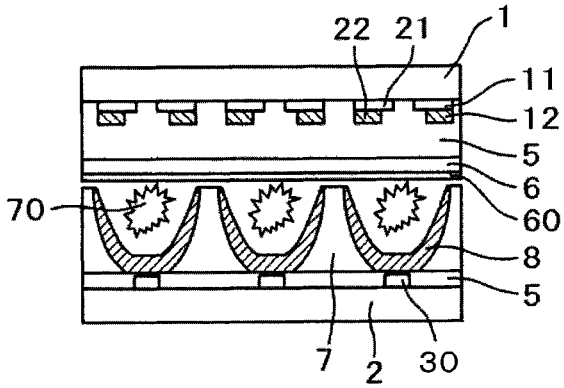
Figure 2C:
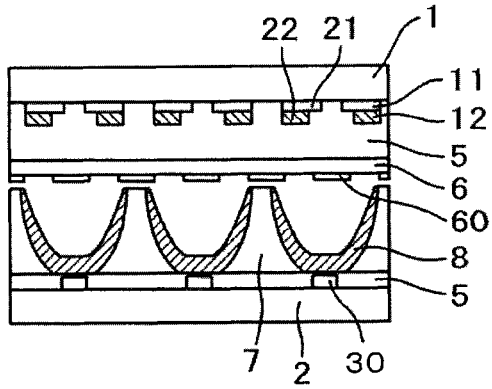
Figure 3:
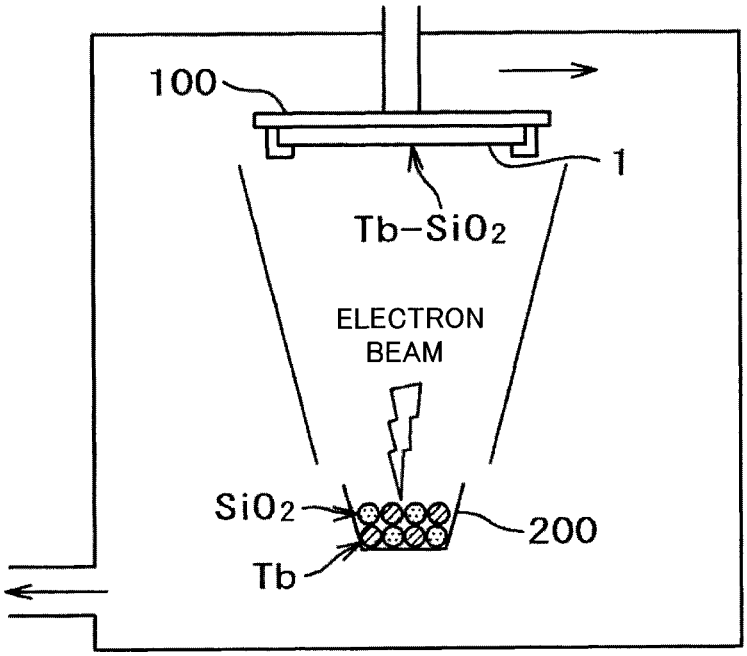
FIG. 3 is a vapor deposition method according to Example 1.
Figure 4:
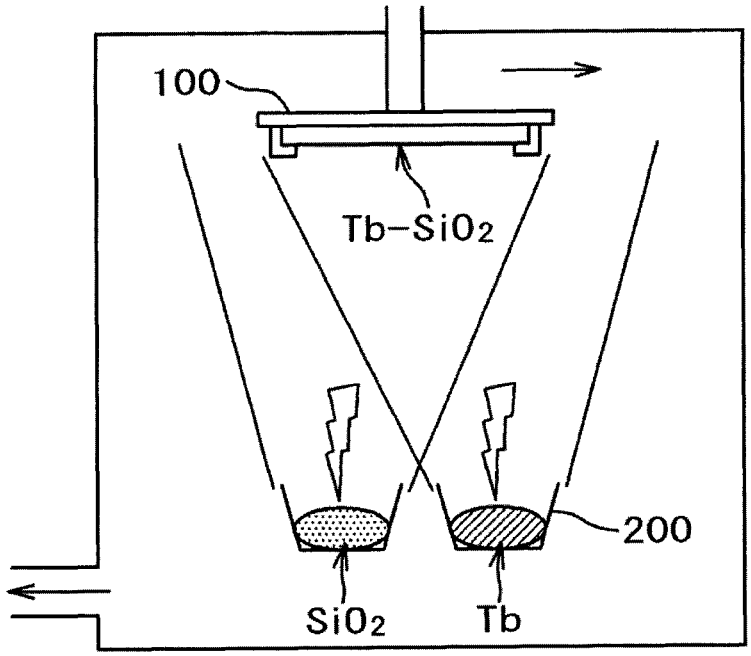
FIG. 4 is a vapor deposition method according to Example 2.
Figure 5:
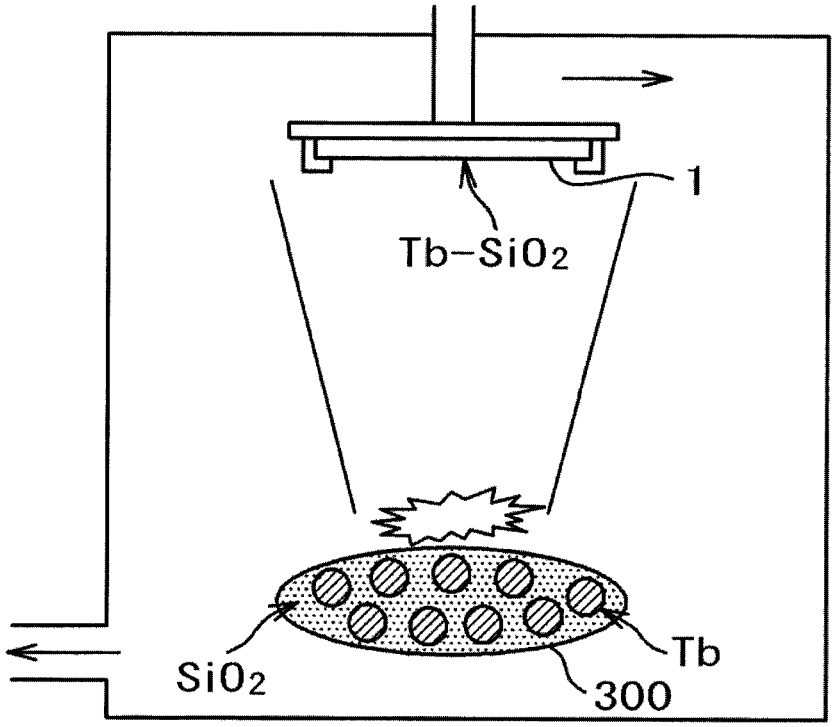
FIG. 5 is an example of forming an inert film by sputtering.

1 . . . Front substrate
2 . . . Back substrate
3 . . . Sealing portion
5 . . . Dielectric layer
6 . . . Protective layer
7 . . . Partition wall
8 . . . Phosphor
10 . . . X electrode
11 . . . X discharge electrode
12 . . . X bus electrode
20 . . . Y electrode
21 . . . Y discharge electrode
22 . . . Y bus electrode
30 . . . Address electrode
60 . . . Inert film
100 . . . Substrate setting jig
200 . . . Vapor deposition hearth
300 . . . Sputtering target

What is claimed is:

1. A plasma display panel comprising:

a front substrate on which a dielectric layer is formed to cover first discharge electrodes and second discharge electrodes and a protective film is formed to cover the dielectric layer; and a back substrate on which a dielectric layer is formed to cover address electrodes and partition walls are formed on the dielectric layer, the front and back substrates being sealed together by a sealing material formed along a periphery, wherein an inert film formed of a metal oxide and a metal is formed on the protective film, a portion of the inert film exposed to a plasma discharge is entirely or partially removed, and wherein, when the amount of metal oxide is x and the amount of metal is y, y/(x+y) ranges from 0.5 mol % to 50 mol %.

2. The plasma display panel according to claim 1, wherein the metal oxide is any of metal oxides of $SiO_2$, $Al_2O_3$, $TiO_2$, MgO and ZrO, and the metal is Tb, La, Ce, Eu, Yb, Y, Sc, Mg, Ca, Sr, Ba, K, or Na.

3. The plasma display panel according to claim 1, wherein the protective film includes MgO, SrO, CaO, BaO or a mixture including them.

4. The plasma display panel according to claim 1, wherein the inert film has a film thickness ranging from 10 nm to 500 nm.

5. A method of manufacturing a plasma display panel including a front substrate on which a dielectric layer is formed to cover first discharge electrodes and second discharge electrodes, a protective film is formed to cover the dielectric layer and an inert film is formed on the protective film, and a back substrate on which a dielectric layer is formed to cover address electrodes and partition walls are formed on the dielectric layer, the front and back substrates being sealed together by a sealing material formed along a periphery, the method comprising the steps of:

simultaneous film formation of a metal oxide and a metal by vapor deposition to form the inert film;

removal of all or a part of a portion of the inert film exposed to a plasma display in an aging step; and wherein the vapor deposition is performed by placing a metal oxide and a metal in different hearths, and then separately heating and controlling the metal oxide and the metal.

* * * * *